US011592029B2

(12) United States Patent
Feng et al.

(10) Patent No.: US 11,592,029 B2
(45) Date of Patent: Feb. 28, 2023

(54) IMPELLER FOR CENTRIFUGAL FAN AND CENTRIFUGAL FAN

(71) Applicant: Air Distribution Technologies IP, LLC, Milwaukee, WI (US)

(72) Inventors: Shifeng Feng, Wuxi (CN); Xiaokui Ma, Wuxi (CN); Li Wang, Wuxi (CN)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 0 days.

(21) Appl. No.: 17/674,678

(22) Filed: Feb. 17, 2022

(65) Prior Publication Data

US 2022/0268294 A1 Aug. 25, 2022

(30) Foreign Application Priority Data

Feb. 22, 2021 (CN) ..... 202110197735.8

(51) Int. Cl.
*F04D 29/28* (2006.01)
*F04D 17/08* (2006.01)

(52) U.S. Cl.
CPC ..... *F04D 29/281* (2013.01); *F04D 17/08* (2013.01)

(58) Field of Classification Search
CPC ..... F04D 29/281; F04D 29/282; F04D 29/283
See application file for complete search history.

(56) References Cited

U.S. PATENT DOCUMENTS 9,206,815 B2 * 12/2015 Shiraichi ..... F04D 29/666
9,995,303 B2 * 6/2018 Ikeda ..... F24F 1/0057

FOREIGN PATENT DOCUMENTS

JP 2006329100 A * 12/2006
JP 2018141371 A * 9/2018

* cited by examiner

*Primary Examiner* — Sabbir Hasan
(74) *Attorney, Agent, or Firm* — Fletcher Yoder, P.C.

(57) ABSTRACT

The present application discloses an impeller for a centrifugal fan and a centrifugal fan. The impeller comprises a support member and several vanes. The support member has an inner wall that defines a hollow portion. The several vanes are arranged inside the hollow portion, each of the several vanes is connected with the inner wall and extends along the axial direction of the support member, and the several vanes are arranged along the circumferential direction of the support member. Each of the several vanes is bent and comprises a front edge, a tail edge, a convex suction surface, and a concave pressure surface, the suction surface and the pressure surface are arranged to oppose each other, and the front edge and the tail edge are arranged to oppose each other, wherein the tail edge is connected with the inner wall of the support member, and wherein several protrusions are provided on the suction surface, and the several protrusions are arranged to be close to the front edge. The protrusions can regulate the flow of a fluid immediately when the fluid contacts the vanes. During the flow regulation process, a large vortex in the fluid can be divided into several small vortices. Such small vortices have smaller friction resistance, and the kinetic energy dissipated from the motion of the small vortices themselves can be partially cancelled out, thereby reducing the noise of the impeller and improving the performance of the centrifugal fan.

9 Claims, 8 Drawing Sheets

IMPELLER FOR CENTRIFUGAL FAN AND CENTRIFUGAL FAN

CROSS-REFERENCE TO RELATED APPLICATIONS

This application claims priority to and the benefit of Chinese Patent Application No. 202110197735.8, filed Feb. 22, 2021, which is herein incorporated by reference in its entirety for all purposes.

FIELD OF THE INVENTION

The present application relates to the field of impellers, and more particularly, to an impeller for a centrifugal fan.

DESCRIPTION OF THE RELATED ART

In existing technologies, vanes in an impeller are arc shaped, and the vane surface is a smooth curved surface. Since the flow separation is serious on the vane surface and vortices are formed, the vanes have poor pneumatic performance and high noise.

SUMMARY OF THE INVENTION

Exemplary embodiments of the present application can solve at least some of the above problems.

According to a first aspect of the present application, the present application provides an impeller for a centrifugal fan, wherein the impeller comprises a support member and several vanes. The support member is cylindrical and has an inner wall that defines a hollow portion. The several vanes are arranged inside the hollow portion, each of the several vanes is connected with the inner wall and extends along the axial direction of the support member, and the several vanes are arranged along the circumferential direction of the support member. Here, each of the several vanes is bent and comprises a front edge, a tail edge, a convex suction surface, and a concave pressure surface, the suction surface and the pressure surface are arranged to oppose each other, and the front edge and the tail edge are arranged to oppose each other, wherein the tail edge is connected with the inner wall of the support member, and wherein several protrusions are provided on the suction surface, and the several protrusions are arranged to be close to the front edge.

According to the impeller in the above first aspect, each of the several vanes has a length direction defined along the axial direction of the support member and a width direction from the front edge to the tail edge. The several protrusions are arranged in several rows along the width direction, and the protrusions in each row are arranged in the length direction, wherein, in the width direction, protrusions in different rows are in a staggered arrangement.

According to the impeller in the above first aspect, projections of the several protrusions on a plane perpendicular to the radial direction of the support member are not overlapped.

According to the impeller in the above first aspect, all the protrusions in each row have the same shape and size.

According to the impeller in the above first aspect, each of the protrusions has a protrusion height, and the protrusion height is a distance between the highest point of the top of the protrusion and the suction surface on an axial cross section of the support member. The shape of each of the several protrusions is set to have the highest point of a top, and the highest points of the tops of all the protrusions in each row are arranged along a straight line parallel to the axial direction of the support member; a distance S between the straight line on which the highest points of the tops of the protrusions in the row farthest from the front edge are located and the straight line on which the ends of the front edge are located and a vane width W satisfy the following:

$$S=A\times W;$$

where the value range of A is greater than or equal to ⅓ and smaller than or equal to ⅔.

According to the impeller in the above first aspect, in the protrusions in each row, the spacing between the highest points of the tops of two adjacent protrusions is the same.

According to the impeller in the above first aspect, the several protrusions are configured as follows: in two adjacent rows of protrusions, the protrusion height of the protrusions in the row close to the front edge is not smaller than the protrusion height of the protrusions in the row close to the tail edge.

According to the impeller in the above first aspect, the tops of the several protrusions have a lower portion located around the highest point.

According to the impeller in the above first aspect, each of the several protrusions is partially spherical, olive shaped, or teardrop shaped.

According to a second aspect of the present application, the present application provides a centrifugal fan, which comprises the above impeller.

The protrusions on the impeller of the present application can regulate the flow of a fluid immediately when the fluid contacts the vanes, and after the flow regulation, no other protrusions contact the regulated fluid again, which prevents the fluid from being disturbed again. During the flow regulation process, a large vortex in the fluid can be divided into several small vortices, the top direction of the vortices is consistent with the fluid moving direction, and the bottom direction of the vortices is opposite to the fluid moving direction. Such small vortices have smaller friction resistance, and the kinetic energy dissipated from the motion of the small vortices themselves can be partially cancelled out, thereby reducing the noise of the impeller and improving the performance of the centrifugal fan.

BRIEF DESCRIPTION OF THE DRAWINGS

Features and advantages of the present application can be better understood by reading the detailed description below with reference to the accompanying drawings. In all the accompanying drawings, the same legends represent the same parts, wherein.

DETAILED DESCRIPTION OF THE INVENTION

Various implementation manners of the present application will be described below with reference to the accompanying drawings that form a part of this description. It should be understood that terms used herein to indicate directions, such as "front," "rear," "up," "down," "left," "right," and the like, are used to describe various example structural parts and elements of the present invention in terms of directions or positions thereof, but the use of these terms herein is merely for ease of description, and these terms are determined according to the example positions shown in the accompanying drawings. Since the embodiments disclosed by the present invention may be arranged according to different directions, these terms that indicate directions merely serve as a description, and shall not be regarded as limitations. In the accompanying drawings below, the same parts use the same legends, and similar parts use similar legends.

Figure 1:
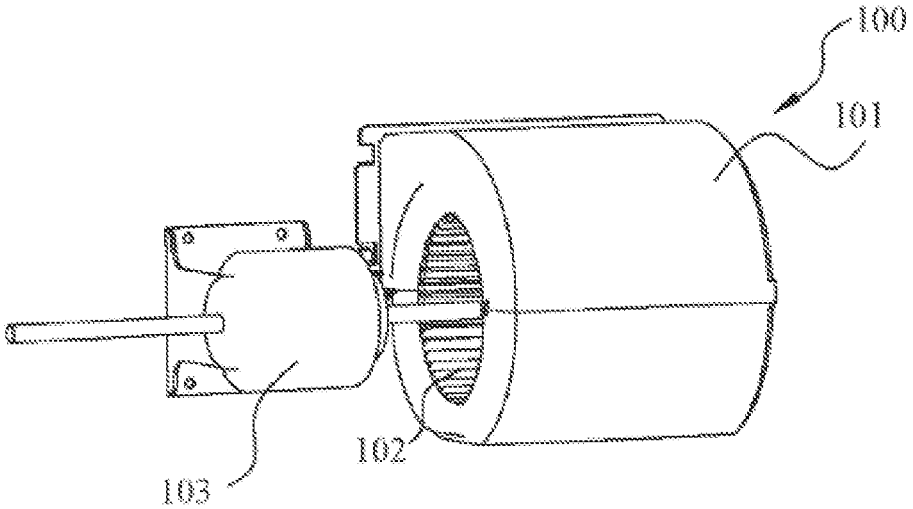
FIG. 1 is a 3D diagram of a centrifugal fan of the present application.

FIG. 1 is a 3D diagram of a centrifugal fan 100 of the present application. As shown in FIG. 1, the centrifugal fan 100 comprises a shell 101, an impeller 102, and a driving device 103. Specifically, the shell 101 is substantially cylindrical and has a hollow shell portion. Left and right sides of the shell 101 are provided with an air inlet, and the circumferential rear of the shell 101 is provided with an air outlet. The impeller 102 is accommodated in the hollow shell portion of the shell 101. The impeller 102 is substantially cylindrical and has a rotation axis X. The driving device 103 is arranged at the left side of the shell 101, and the driving axis of the driving device 103 is arranged coaxially with the rotation axis X of the impeller 102. The driving axis of the driving device 103 is connected with the impeller 102 to drive the impeller 102 to rotate. When the driving device 103 is started, the impeller 102 rotates around the rotation axis X, and a fluid (e.g., wind) can enter the shell 101 from the air inlets at the left and right sides and then be discharged from the air outlet at the rear of the shell 101.

Figure 2:
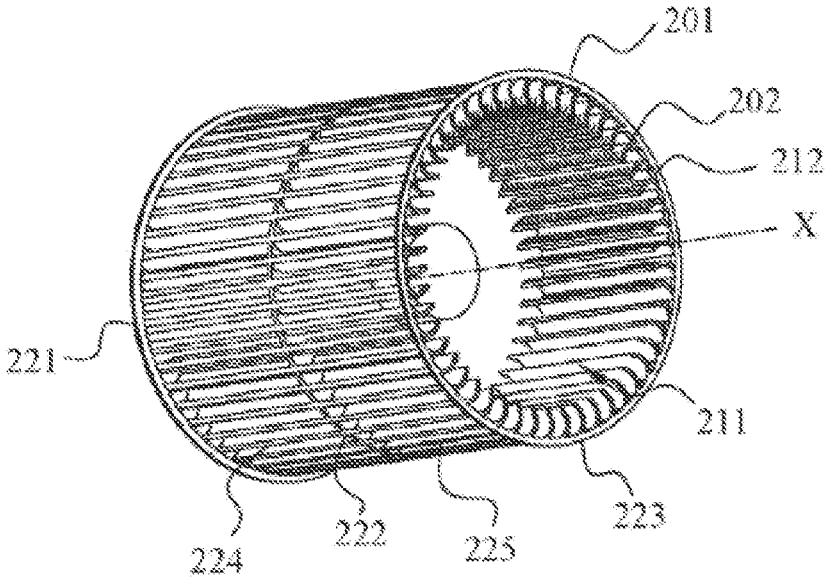
FIG. 2 is a 3D diagram of the impeller shown in FIG. 1.

FIG. 2 is a 3D diagram of the impeller 102 shown in FIG. 1. As shown in FIG. 2, the impeller 102 comprises a support member 201. The support member 201 is cylindrical and has an inner wall 212 that defines a hollow portion of the support member. Specifically, the support member 201 comprises a first ring 221, a second ring 222, a third ring 223, several first support rods 224, and several second support rods 225. The several first support rods 224 are arranged between the first ring 221 and the second ring 222, and the left end of each of the several first support rods 224 is connected to the first ring 221, while the right end of each of the several first support rods 224 is connected to the second ring 222. The several first support rods 224 are evenly arranged along the circumferential direction of the support member 201. The several first support rods 224 are arranged at intervals. Similarly, the several second support rods 225 are arranged between the second ring 222 and the third ring 223, and the left end of each of the several second support rods 225 is connected to the second ring 222, while the right end of each of the several second support rods 225 is connected to the third ring 223. The several second support rods 225 are evenly arranged along the circumferential direction of the support member 201. The several second support rods 225 are arranged at intervals. The number of the several first support rods 224 is the same as the number of the several second support rods 225, and the several first support rods 224 and the several second support rods 225 are correspondingly arranged. In other words, each first support rod 224 of the several first support rods 224 and a corresponding second support rod 225 are arranged on the same straight line, and the straight line is parallel to the rotation axis X of the impeller 102. It should be noted that, while each first support rod 224 of the several first support rods 224 and a corresponding second support rod 225 are arranged on the same straight line in the present application, a person skilled in the art can understand that each first support rod 224 of the several first support rods 224 and a corresponding second support rod 225 may also be arranged at an angle.

As shown in FIG. 2, the impeller 102 further comprises several vanes 202. Each of the several vanes 202 is connected with the inner wall 212. The several vanes 202 are formed by extending along the circumferential direction of the support member 201. The number of the several vanes 202 is arranged to correspond to the number of the several first support rods 224 and the several second support rods 225. In other words, the vanes 202 are arranged on the inner wall 212 of the first support rods 224 and the second support rods 225.

In the examples of the present application, the impeller 102 is an impeller with air intake at left and right sides. A person skilled in the art can understand that, for an impeller with air intake at a single side (i.e., either the left side or the right side), only two support rings and several vanes 202 arranged between the two support rings are needed. Therefore, each vane 202 in the several vanes 202 to be described below refers to a vane 202 arranged between the first ring 221 and the second ring 222 or a vane 202 arranged between the second ring 222 and the third ring 223.

Figure 3:
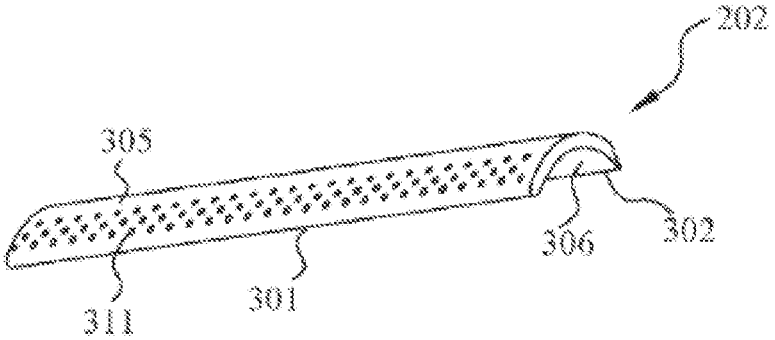
FIG. 3 is a 3D diagram of the vane shown in FIG. 2.

FIG. 3 is a 3D diagram of the vane 202 shown in FIG. 2, so as to illustrate a specific structure of the vane 202. As shown in FIG. 3, the vane 202 is bent and comprises a front edge 301, a tail edge 302, a suction surface 305, and a pressure surface 306, wherein the front edge 301 and the tail edge 302 are arranged to oppose each other, the tail edge 302 is connected with the inner wall 212 of the support member 201 (e.g., the first support rods 224 and/or the second support rod 225), the suction surface 305 and the pressure surface 306 are arranged to oppose each other, the suction surface 305 is convex, while the pressure surface 306 is concave. The vane 202 has a vane length L defined along the axial direction of the support member 201 and a vane width W from the front edge 301 to the tail edge 302. Several protrusions 311 are arranged on the suction surface 305, and the several protrusions 311 are arranged to be close to the front edge 301. The protrusions 311 may be of a variety of shapes, such as partially spherical, olive shaped, or teardrop shaped.

Figure 4:
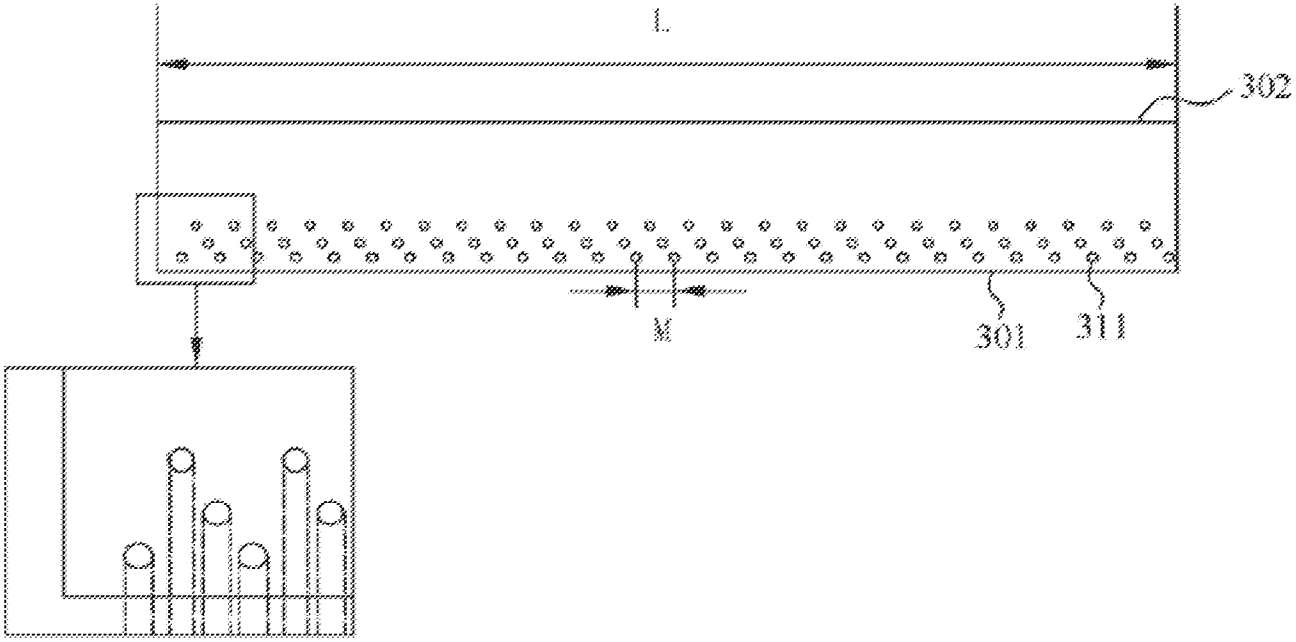
FIG. 4 is a top view of the vane shown in FIG. 3, wherein the protrusion is partially spherical.
Figure 5A:
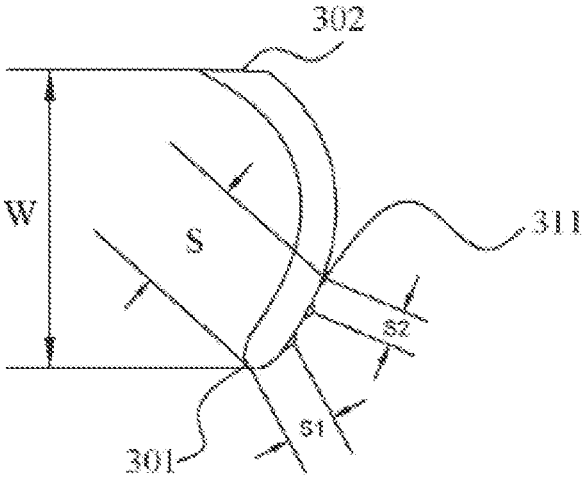
FIGS. 5A-5B are radial cross-sectional views of the vane shown in FIG. 4.
Figure 5B:
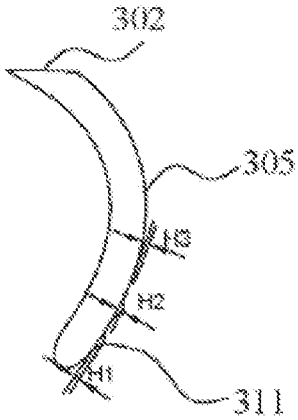

FIG. 4 is a top view of the vane 202 shown in FIG. 3, and FIGS. 5A-5B are radial cross-sectional views of the vane 202 shown in FIG. 4, so as to further illustrate a specific structure of the vane 202 and several protrusions 311. As shown in FIGS. 4-5B, the several protrusions 311 are arranged in three rows along the width direction of the vane 202, and the protrusions 311 in each row are arranged in the length direction of the vane 202. In the width direction of the vane 202, protrusions 311 in different rows are in a staggered arrangement. As shown in the enlarged view of FIG. 4, the dot-and-dash lines represent the projections of the protrusions 311 in the length direction (i.e., on a plane perpendicular to the radial direction of the support member 201). It can be seen from the enlarged view, the projections of the protrusions 311 in the length direction are not overlapped. After a fluid enters the impeller 102 through the air intakes, the fluid first contacts the front edge 301 of the vane 202 and flows to the tail edge 302. The several protrusions 311 arranged to be close to the front edge 301 can regulate the flow of the fluid by dividing a large vortex produced by rotation into several small vortices, and after the protrusions 311 arranged to be closer to the front edge 301 contact the fluid, the protrusions 311 close to the rear edge 302 (i.e., the back row) will not contact the fluid that has been regulated by the protrusions 311. In this way, the fluid velocity distribution in the impeller 102 is more uniform.

As shown in FIGS. 4-5B, the protrusions 311 arranged on the suction surface 305 have the same shape, but protrusions 311 in different rows may have different sizes. Specifically, the protrusions 311 have a top. The top comprises the highest point and a lower portion located around the highest point. In other words, the highest point of the top of a protrusion 311 is located in the center of the protrusion 311, such that there is a relatively smooth transition from the highest point to the suction surface 305. On an axial cross section of the support member 201, a distance between the highest point of the top and the suction surface 305 is greater than the distance between any other point on the protrusion 311 and the suction surface 305. Since the protrusion 311 is a symmetric pattern, the highest point of the top is located on the geometric central axis of the protrusion 311. The geometric central axis of the protrusion 311 is arranged to be perpendicular to the suction surface 305. As shown in FIG. 5A, the highest points of the tops of all the protrusions 311 in each row are arranged along a straight line parallel to the axial direction of the support member 201. A distance S between the straight line on which the highest points of the tops of the protrusions 311 in the row farthest from the front edge 301 are located and the straight line on which the ends of the front edge 301 are located and a vane width W satisfy the following:

$$S=A\times W;$$

where the value range of A is greater than or equal to ⅓ and smaller than or equal to ⅔.

The distance between the straight line on which the highest points of the tops of the protrusions 311 in the first row are located and the straight line on which on which the highest points of the tops of the protrusions 311 in the second row are located is the distance S1, and the distance between the straight line on which the highest points of the tops of the protrusions 311 in the second row are located and the straight line on which on which the highest points of the tops of the protrusions 311 in the third row are located is the distance S2. The distance S, the distance S1, and the distance S2 satisfy the following:

$$S1=B\times S, S2=\tfrac{1}{2}(S-S1);$$

where the value range of B is greater than or equal to ¼ and smaller than or equal to ⅓.

The protrusion height H is a distance between the highest point of the top of each protrusion 311 and the suction surface 305. The protrusions 311 in each have the same protrusion height H. Here, the protrusions 311 that are the closest to the front edge 301 are the first row, and the protrusion height of each protrusion 311 in the first row is H1. The protrusion height of each protrusion 311 in the second row is H2. The protrusion height of each protrusion 311 in the third row is H3. The several protrusions 311 are configured as follows: in two adjacent rows of protrusions 311, the protrusion height of the protrusions 311 in the row close to the front edge 301 is not smaller than the protrusion height of the protrusions 311 in the row close to the tail edge 302. In other words, in two adjacent rows of protrusions 311, the protrusion height of the protrusions 311 in the row close to the front edge 301 is greater than or equal to the protrusion height of the protrusions 311 in the row close to the tail edge 302. The protrusion height of the protrusions 311 arranged to be close to the tail edge 302 should not exceed the protrusion height of the protrusions 311 in the row close to the front edge 301, which can prevent the protrusions 311 from generating an additional vortex.

As an example, the protrusion height H1, the protrusion height H2, and the protrusion height H3 satisfy the following:

$$H1\leq 0.25\text{ mm};\ H2=C\times H1;\ H3=D\times H2;$$

where the value range of C is greater than or equal to 0.9 and smaller than or equal to 1, and the value range of D is greater than or equal to 0.9 and smaller than or equal to 1.

As described above, the protrusions 311 may be of a variety of shapes, such as partially spherical, olive shaped, or teardrop shaped. As the first embodiment, the protrusions 311 shown in FIGS. 4-5B are partially spherical. Specifically, the partially spherical protrusions 311 have a spherical diameter D, and all the protrusions 311 in each row have the same spherical diameter D. Here, the protrusions 311 that are the closest to the front edge 301 are the first row, and the spherical diameter of each protrusion 311 in the first row is D1. The spherical diameter of each protrusion 311 in the second row is D2. The spherical diameter of each protrusion 311 in the third row is D3. The spherical diameter D1, the spherical diameter D2, and the spherical diameter D3 satisfy the following:

$$D1=E\times W;\ D2=F\times D1;\ D3=G\times D2;$$

where the value range of E is greater than or equal to 0.06 and smaller than or equal to 0.08, the value range of F is greater than or equal to 0.9 and smaller than or equal to 1, and the value range of G is greater than or equal to 0.9 and smaller than or equal to 1.

In addition, for protrusions 311 in the same row, the protrusions 311 are arranged evenly at an interval along the length direction of the vane 202. The spacing between the highest points of the tops of two adjacent protrusions 311 is M. The spacing M satisfies the following:

$$M=4\times D1.$$

Figure 6:
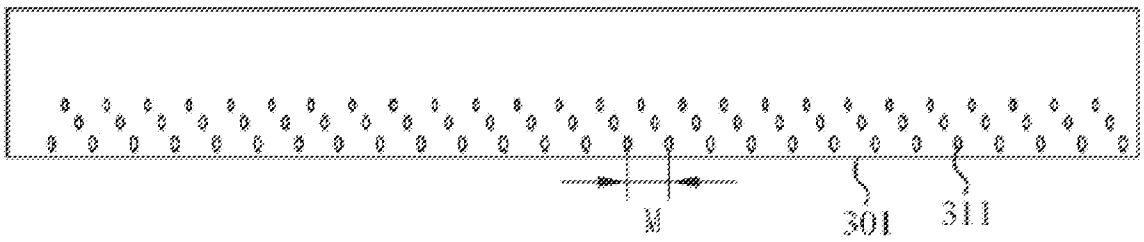
FIG. 6 is a top view of a second embodiment of the vane shown in FIG. 3.
Figure 7:
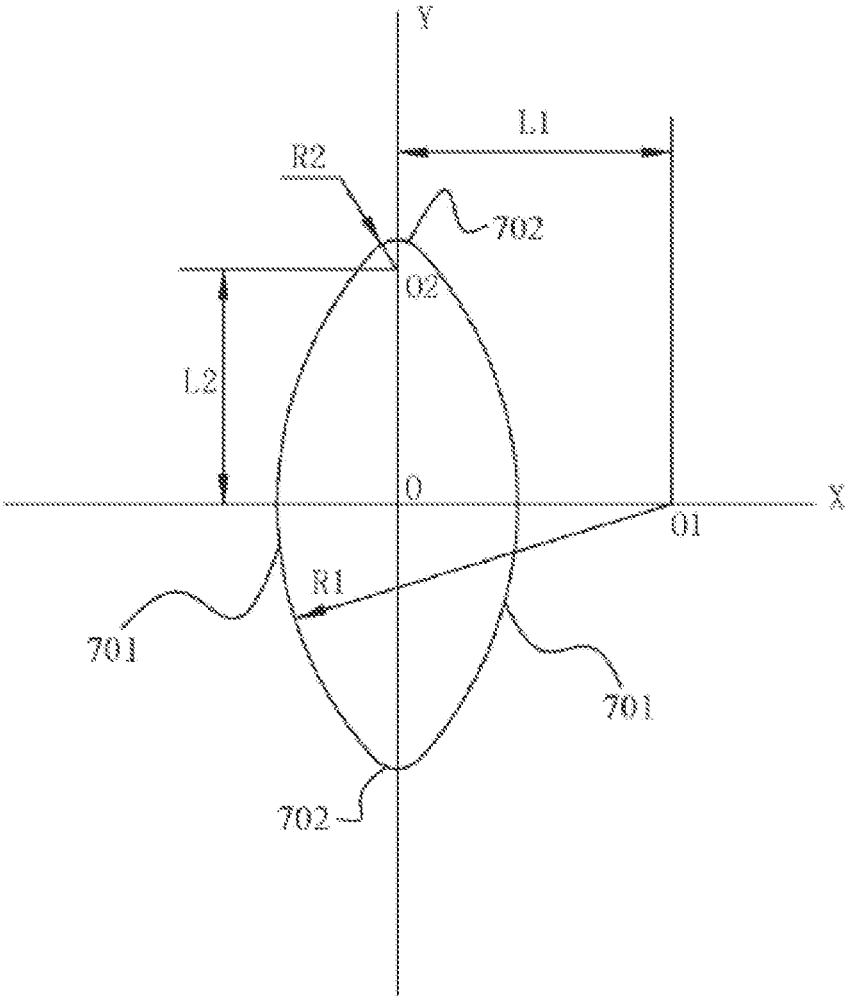
FIG. 7 is an enlarged view of an olive-shaped protrusion.

FIG. 6 is a top view of the second embodiment of the vane 202 shown in FIG. 3, wherein the protrusion 311 is olive shaped. FIG. 7 is an enlarged view of an olive-shaped protrusion 311. Specifically, edges of the olive-shaped protrusion 311 comprise first edges 701 located at the left and the right and second edges 702 located at the top and the bottom. The first edges 701 and second edges 702 are all arcs, the radius of the first edges 701 is R1, and the radius of the second edges 702 is R2. The edges of the olive-shaped protrusion 311 are symmetric with respect to the axis X and the axis Y. The intersection point of the axis X and the axis Y is O, which is the highest point of the top of the protrusion 311. The center of circle O1 of the first edges 701 having the radius R1 is located on the axis X, and the distance between O1 and the intersection point O is L1. The center of circle O2 of the second edges 702 having the radius R2 is located on the axis Y, and the distance between O2 and the intersection point O is L2. The radius R1 of the first edges 701, the distance L1 between the center of circle O1 and the intersection point O, the radius R2 of the second edges 702, and the distance L2 between the center of circle O2 and the intersection point O satisfy the following:

$$R1=K1\times W;\ L1=K2\times W;\ R2=K3\times W;\ L2=K4\times W;$$

where the value range of K1 is greater than or equal to 0.5 and smaller than or equal to 1.2, the value range of K2 is greater than or equal to 0.07 and smaller than or equal to 0.09, the value range of K3 is greater than 0 and smaller than or equal to 0.04, and the value range of K4 is greater than 0.05 and smaller than or equal to 0.07.

In addition, for protrusions 311 in the same row, the protrusions 311 are arranged evenly at an interval along the length direction of the vane 202. The spacing between the highest points of the tops of two adjacent protrusions 311 is M. The spacing M satisfies the following:

$$M=8\times(R1-L1).$$

Figure 8:
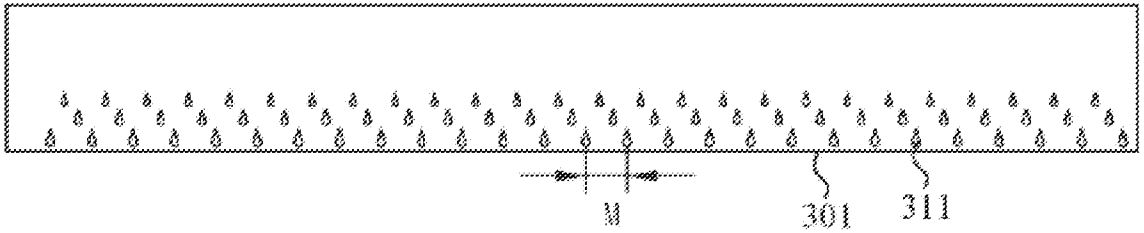
FIG. 8 is a top view of a third embodiment of the vane shown in FIG. 3.
Figure 9:
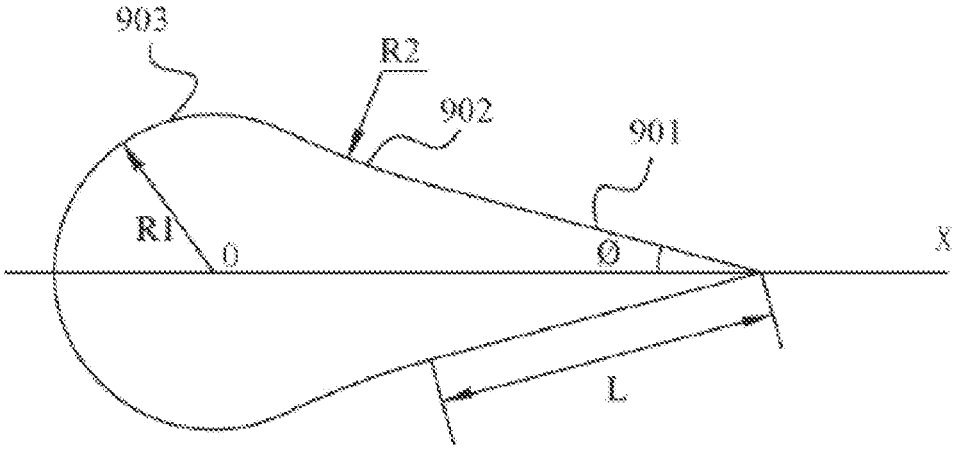
FIG. 9 is an enlarged view of a teardrop-shaped protrusion.

FIG. 8 is a top view of the third embodiment of the vane 202 shown in FIG. 3, wherein the protrusion 311 is teardrop shaped. FIG. 9 is an enlarged view of a teardrop-shaped protrusion 311. Specifically, edges of the teardrop-shaped protrusion 311 comprise a first edge 901 located at the left, second edges 902 located at the top and the bottom, and a third edge 903 located at the right. The first edge 901 and the second edges 902 are all arcs, the radius of the first edge 901 is R1, and the radius of the second edges 902 is R2. The third edge 903 is a straight line. The edges of the teardrop-shaped protrusion 311 are symmetric with respect to the axis X. The radius R1 of the first edge 901 is 0, which is the highest point of the top of the protrusion 311 and located on the axis X. The angle formed between the third edge 903 at the right and the axis X is Φ. The value range of the angle Φ is greater than or equal to 8° and smaller than or equal to 12°. The length of the third edge 903 is L. The radius R1 of the first edge 901, the radius R2 of the second edges 902, and the length L of the third edge 903 satisfy the following:

$$R1=J1\times W;\ R2=J2\times W;\ L2=J3\times W;$$

where the value range of J1 is greater than or equal to 0.04 and smaller than or equal to 0.05, the value range of J2 is greater than or equal to 0.3 and smaller than or equal to 0.52, and the value range of J3 is greater than or equal to 0.05 and smaller than or equal to 0.07.

In addition, for protrusions 311 in the same row, the protrusions 311 are arranged evenly at an interval along the length direction of the vane 202. The spacing between the highest points of the tops of two adjacent protrusions 311 is M. The spacing M satisfies the following:

$$M=8\times R1.$$

An impeller with no protrusions may have a higher turbulent kinetic energy than an impeller including protrusions. Upon calculation and analysis, under the same air flow rate and rotation speed, the turbulent kinetic energy of the impeller with no protrusions is about 1.2 KJ, while the turbulent kinetic energy is respectively 1.11 KJ, 1.1 KJ, and 1.12 KJ for the impellers with partially spherical protrusions, olive-shaped protrusions, and teardrop-shaped protrusions. The turbulent kinetic energy thereof can be reduced by about 10% compared with the impeller with no protrusions.

In addition, compared with the arrangement of the protrusions at other positions of a vane, the protrusions arranged to be close to the front edge 301 can regulate the flow of a fluid immediately when the fluid contacts the vanes, and after the flow regulation, no other protrusions contact the regulated fluid again, which prevents the fluid from being disturbed again. During the flow regulation process, a large vortex in the fluid can be divided into several small vortices, the top direction of the vortices (close to the front edge 301) is consistent with the fluid moving direction, and the bottom direction thereof (close to the tail edge 302) is opposite to the fluid moving direction. Such small vortices have smaller friction resistance, and the kinetic energy dissipated from the motion of the small vortices themselves can be partially cancelled out, thereby reducing the noise of the impeller and improving the performance of the centrifugal fan.

It should be noted that, although the protrusions being arranged in three rows is illustrated in the present application, any number of rows of the protrusions shall all fall within the protection scope of the present application.

Only some features of the present application are illustrated and described herein, and a person skilled in the art may carry out a variety of improvements and variations. Therefore, it should be understood that the appended claims are intended to encompass all the above-described improvements and variations that fall within the substantive spirit and scope of the present application.

The invention claimed is:

1. An impeller for a centrifugal fan, wherein the impeller comprises:

a support member, wherein the support member is cylindrical and has an inner wall that defines a hollow portion; and a plurality of vanes arranged inside the hollow portion, wherein each vane of the plurality of vanes is connected with the inner wall and extends along an axial direction of the support member, and the plurality of vanes is arranged along a circumferential direction of the support member, wherein each vane of the plurality of vanes is bent and comprises a front edge, a tail edge, a convex suction surface, and a concave pressure surface, the convex suction surface and the concave pressure surface are arranged to oppose each other, and the front edge and the tail edge are arranged to oppose each other, wherein the tail edge is connected with the inner wall of the support member, wherein a plurality of protrusions is provided on the convex suction surface, and the plurality of protrusions is arranged proximate the front edge, wherein each vane of the plurality of vanes has a length direction defined along the axial direction of the support member and a width direction from the front edge to the tail edge, wherein the plurality of protrusions is arranged in a plurality of rows along the width direction, and respective protrusions in each row of the plurality of rows are arranged in the length direction, and wherein, in the width direction, respective protrusions in different rows are in a staggered arrangement relative to one another.

2. The impeller of claim 1, wherein:

projections of the plurality of protrusions on a plane perpendicular to a radial direction of the support member are not overlapped.

3. The impeller of claim 1, wherein:

the respective protrusions in each row of the plurality of rows have the same shape and size.

4. The impeller of claim 3, wherein:

each protrusion of the plurality of protrusions is partially spherical, olive shaped, or teardrop shaped.

5. The impeller of claim 1, wherein:

each protrusion of the plurality of protrusions has a protrusion height, and the protrusion height is a distance between a highest point of a top of the respective protrusion and the convex suction surface on an axial cross section of the support member, a shape of each protrusion of the plurality of protrusions defines the highest point of the top, and the highest points of the tops of the respective protrusions in each row of the plurality of rows are arranged along a straight line parallel to the axial direction of the support member, a distance S between the respective straight line on which the highest points of the tops of the respective protrusions in a row of the plurality of rows farthest from the front edge are located and an additional straight line on which ends of the front edge are located and a vane width W satisfy the following:

$$S=A\times W;$$

where a value range of A is greater than or equal to ⅓ and smaller than or equal to ⅖.

6. The impeller of claim 5, wherein:

for the respective protrusions in each row of the plurality of rows, a spacing between the highest points of the tops of two adjacent protrusions is the same.

7. The impeller of claim 5, wherein:

the plurality of protrusions is arranged such that: in two adjacent rows of protrusions, the protrusion heights of the respective protrusions in a first row closer to the front edge is not smaller than the protrusion heights of the respective protrusions in a second row closer to the tail edge.

8. The impeller of claim 5, wherein:

the respective top of each protrusion of the plurality of protrusions each comprises a lower portion located proximate the corresponding highest point.

9. A centrifugal fan, wherein:

the centrifugal fan comprises the impeller according to claim 1.

* * * * *